US012390856B2

(12) United States Patent
Licitar

(10) Patent No.: US 12,390,856 B2
(45) Date of Patent: Aug. 19, 2025

(54) APPARATUSES AND METHODS FOR PRODUCING NANOPARTICLES FROM MATERIAL IN WORKING LIQUID

(71) Applicant: Antonijo Licitar, Zagreb (HR)

(72) Inventor: Antonijo Licitar, Zagreb (HR)

( * ) Notice: Subject to any disclaimer, the term of this patent is extended or adjusted under 35 U.S.C. 154(b) by 0 days.

(21) Appl. No.: 18/910,554

(22) Filed: Oct. 9, 2024

(65) Prior Publication Data

US 2025/0196226 A1 Jun. 19, 2025

(51) Int. Cl.
*B22F 9/10* (2006.01)

(52) U.S. Cl.
CPC ..... *B22F 9/10* (2013.01); *B22F 2304/054* (2013.01)

(58) Field of Classification Search
CPC ..... B22F 2304/054; B22F 9/082; B22F 2009/0812; B22F 2009/0824; B22F 2202/17; B22F 2009/042; B22F 9/04; B33F 9/10; B02C 17/168; B02C 17/1855; B02C 13/205; B02C 13/20
See application file for complete search history.

(56) References Cited

U.S. PATENT DOCUMENTS

2021/0322997 A1* 10/2021 Licitar ..... B02C 17/16

* cited by examiner

*Primary Examiner* — Ricardo D Morales
(74) *Attorney, Agent, or Firm* — DLA PIPER LLP (US)

(57) ABSTRACT

The present disclosure relates to systems and methods for producing nanoparticles of a material in a working liquid. The apparatus can include a core for accelerating the working liquid and the material, wherein the core includes: a first cylinder including: a radially outer surface and a radially inner surface; and a plurality of first through holes extending from the radially inner surface to the radially outer surface of the first cylinder; a second cylinder including: a radially outer surface and a radially inner surface; and a plurality of second through holes extending from the radially inner surface to the radially outer surface of the second cylinder; wherein the second cylinder radially surrounds the first cylinder; wherein each of the first through holes and the second through holes have a smaller cross-section at the radially inner surface than at the radially outer surface.

11 Claims, 4 Drawing Sheets

APPARATUSES AND METHODS FOR PRODUCING NANOPARTICLES FROM MATERIAL IN WORKING LIQUID

CROSS-REFERENCE TO RELATED APPLICATIONS

This application claims priority to European Application No. 23217346.8 filed on Dec. 15, 2023, which is hereby incorporated by reference in its entirety.

FIELD

The present disclosure relates to apparatuses for producing particles, particularly nanoparticles, as well as top-down methods for producing particles using such apparatuses. The apparatuses of the present disclosure may process materials in a working liquid.

BACKGROUND

Nanoparticles have at least one of their dimensions, optionally all their dimensions, between 1 nm and 100 nm. As the surface area to volume ratio of the material increases in the nanoscale, the properties of the nanoparticles may be different from the properties of larger particles. Nanoparticles are used in a wide range of fields, for example, medicine, electronics, materials science, and others.

One known method for obtaining nanoparticles involves a mechanical mill, disclosed in U.S. Pat. Nos. 11,154,868 B2 and 11,607,693 B2, which are incorporated by reference herein in their entirety. In these documents, two rotors including aerodynamical blades which can be rotated in opposite directions are described. However, it has been discovered that these designs are not capable of producing more than about 5% of nanoparticles from the input material. Additionally, blade damage and abrasion occur which further reduce the efficiency of these systems. The input material collides with the blades and is broken down due to the collisions with the blades and deteriorating the blades themselves. The material removed from the blades may contaminate the environment and may produce nanoparticles which include impurities.

There remains a need for systems and methods that can efficiently produce nanoparticles with minimal impurities and reduced damage to the system. The present disclosure aims at resolving and reducing one or more of the above mentioned disadvantages.

SUMMARY

In some aspects, the techniques described herein relate to an apparatus for producing nanoparticles of a material in a working liquid, including: one or more inlets for introducing the working liquid, the material, or a combination thereof into the apparatus; a core for accelerating the working liquid and the material, wherein the core includes: a first cylinder including: a radially outer surface and a radially inner surface; and a plurality of first through holes extending from the radially inner surface to the radially outer surface of the first cylinder; a second cylinder including: a radially outer surface and a radially inner surface; and a plurality of second through holes extending from the radially inner surface to the radially outer surface of the second cylinder; wherein the second cylinder radially surrounds the first cylinder; wherein each of the first through holes and the second through holes have a smaller cross-section at the radially inner surface than at the radially outer surface; and one or more drives for rotating the first cylinder, the second cylinder, or a combination thereof.

In some aspects, the techniques described herein relate to an apparatus, wherein the plurality of first through holes, the plurality of second through holes, or a combination thereof each have a substantially elliptical cross-section.

In some aspects, the techniques described herein relate to an apparatus, wherein the plurality of first through holes, the plurality of second through holes, or a combination thereof include a first side edge and a second side edge in a cross-section perpendicular to an axial direction of the first cylinder and the second cylinder, and wherein the first side edge is curved and the second side edge is straight.

In some aspects, the techniques described herein relate to an apparatus, wherein at least some of the plurality of first through holes are arranged in first circumferential rows and at least some of the plurality of second through holes are arranged in second circumferential rows, wherein one or more of the first circumferential rows have a same axial position as one or more of the second circumferential rows.

In some aspects, the techniques described herein relate to an apparatus, wherein the first and second circumferential rows have a constant pitch within a row.

In some aspects, the techniques described herein relate to an apparatus, wherein the first cylinder and the second cylinder have a radial separation of 10 microns to 1 cm.

In some aspects, the techniques described herein relate to an apparatus, wherein a distance between each of the plurality of second through holes is larger than a distance between each of the plurality of first through holes.

In some aspects, the techniques described herein relate to an apparatus, further including a third cylinder, including: a radially outer surface and a radially inner surface; and a plurality of third through holes extending from the radially inner surface to the radially outer surface; wherein the third cylinder surrounds the second cylinder; and wherein the plurality of third through holes have a smaller cross-section of at the radially inner surface than at the radially outer surface.

In some aspects, the techniques described herein relate to an apparatus, wherein the first cylinder further includes a plurality of grinding balls.

In some aspects, the techniques described herein relate to an apparatus, further including a separator system for separating the material from the working liquid.

In some aspects, the techniques described herein relate to an apparatus, further including a collection system for collecting the nanoparticles of the material.

In some aspects, the techniques described herein relate to a method of producing nanoparticles of a material in a working liquid, including: introducing the material and the working liquid into the core of an apparatus including: a core for accelerating the working liquid and the material, wherein the core includes: a first cylinder including: a radially outer surface and a radially inner surface; and a plurality of first through holes extending from the radially inner surface to the radially outer surface of the first cylinder; a second cylinder including: a radially outer surface and a radially inner surface; and a plurality of second through holes extending from the radially inner surface to the radially outer surface of the second cylinder; wherein the second cylinder radially surrounds the first cylinder; rotating the first cylinder, the second cylinder, or a combination thereof; accelerating the working liquid to cause a cavitation effect;

and changing a flow direction of the working liquid to cause a water hammer effect; thereby producing nanoparticles of the material.

In some aspects, the techniques described herein relate to a method, wherein the first cylinder and the second cylinder are rotated in opposite directions.

In some aspects, the techniques described herein relate to a method, wherein the material includes an oxidizable metallic material.

In some aspects, the techniques described herein relate to a method, wherein the material includes silicon, aluminum, calcium, magnesium, iron, zinc, or combinations thereof.

In some aspects, the techniques described herein relate to a method, wherein the working liquid includes water.

In some aspects, the techniques described herein relate to a method, further including generating hydrogen.

In some aspects, the techniques described herein relate to a method, further including generating syngas, methane, carbon monoxide, carbon dioxide, oxygen, or combinations thereof.

In some aspects, the techniques described herein relate to a method, further including setting an atmosphere inside the core.

In some aspects, the techniques described herein relate to a method, further including adding one or more additives to the working liquid and the material.

BRIEF DESCRIPTION OF THE DRAWINGS

Aspects, features, benefits, and advantages of the embodiments described herein will be apparent with regard to the following description, appended claims, and accompanying drawings where:

DETAILED DESCRIPTION

Figure 1:
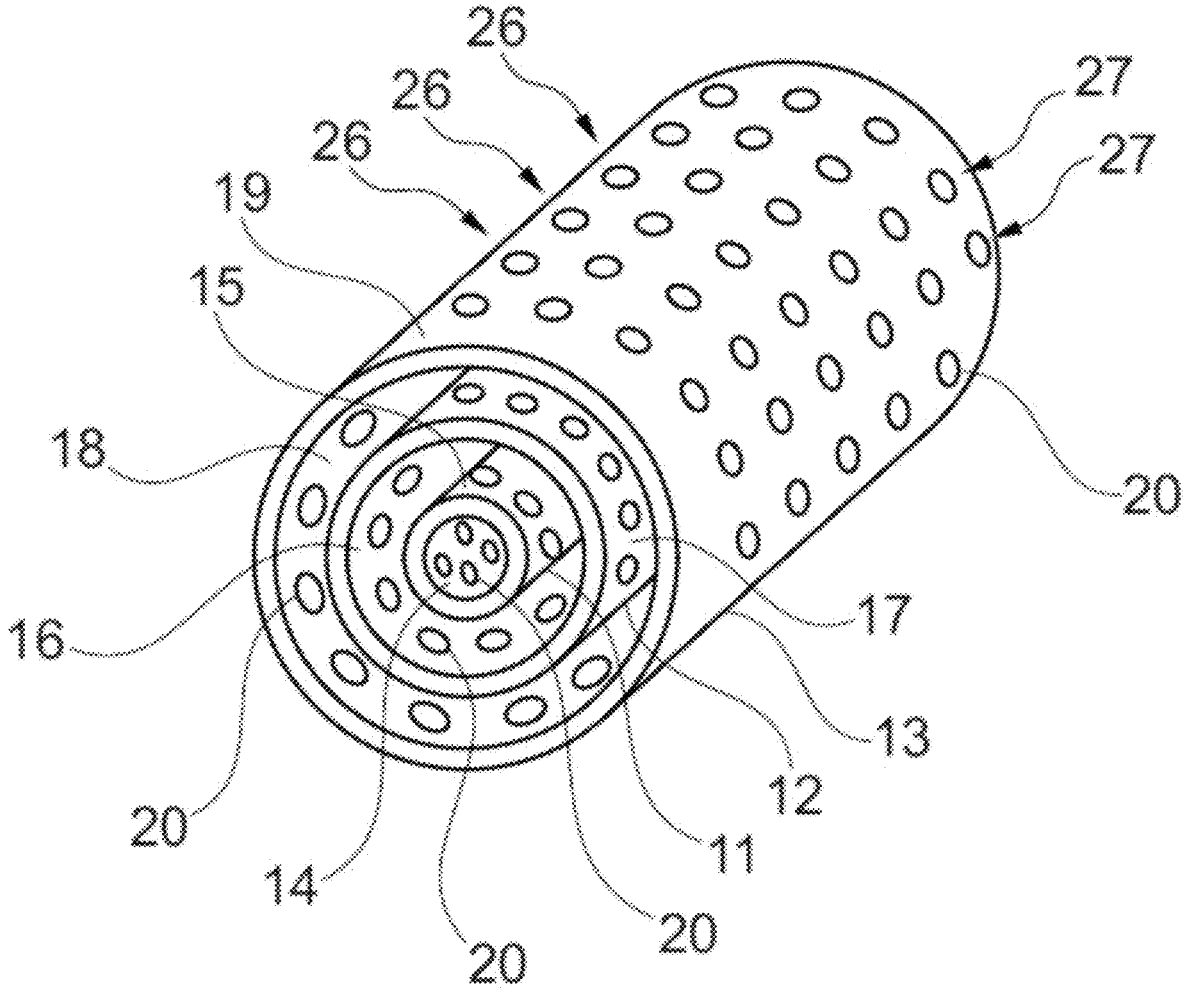
FIG. 1 schematically illustrates a perspective view of an example of three cylinders for accelerating a working liquid comprising a material, according to an embodiment of the present disclosure.

The present disclosure describes systems and methods for producing nanoparticles of a material in a working liquid. The production of nanoparticles is a commercially valuable process, as many high-value materials are desired at the nanoparticle-scale. The present disclosure describes systems and methods which can efficiently produce nanoparticles with few defects while also minimizing damage to the apparatus and components. The present apparatuses and methods are specifically configured to operate efficiently with working liquid materials, or materials suspended in a working liquid, which aims to overcome a deficiency in prior systems which may be optimized for operation with dry materials only.

Apparatus for Producing Nanoparticles

In embodiments, there is provided an apparatus for producing nanoparticles of a material in a working liquid, including: one or more inlets for introducing the working liquid, the material, or a combination thereof into the apparatus; a core for accelerating the working liquid and the material, wherein the core includes: a first cylinder including: a radially outer surface and a radially inner surface; and a plurality of first through holes extending from the radially inner surface to the radially outer surface of the first cylinder; a second cylinder including: a radially outer surface and a radially inner surface; and a plurality of second through holes extending from the radially inner surface to the radially outer surface of the second cylinder; wherein the second cylinder radially surrounds the first cylinder; wherein each of the first through holes and the second through holes have a smaller cross-section at the radially inner surface than at the radially outer surface; and one or more drives for rotating the first cylinder, the second cylinder, or a combination thereof.

Other examples of apparatuses and methods for producing nanoparticles of a material can be found in European Patent Application Nos. 23382949, 23382949, and 23383307, all of which are incorporated by reference herein in their entirety.

In embodiments, the working liquid can include water (including sea water, waste water, or other non-potable water source), fuels such as diesel, bio diesel, or gasoline, or other liquids which are suitable for suspending a material therein. That is, the working liquid should not chemically react with the material. In embodiments, the material can include an oxidizable metallic material such as metals including iron, aluminum, calcium, magnesium, zinc, and the like, as well as metalloids such as silicon. In embodiments, the material can include minerals or composites including the aforementioned elements. The material itself is not particularly limited and may include a material which has an initial particle size, wherein the material is reduced to a smaller size after the material is processed using the apparatus of the present disclosure. Further details regarding the material and the working liquid are provided in later sections of this disclosure.

In embodiments, the working liquid and the material can be introduced to the apparatus together or separately. Further details are provided in later sections of this disclosure.

FIG. 1 schematically illustrates a perspective view of an example of the cylinders of a core for accelerating a working liquid including a material, colliding the material with itself, achieving a water hammer effect and a cavitation effect, and producing nanoparticles. Such a core may be used in an apparatus for producing nano particles.

In embodiments, the core includes a first cylinder 11 and a second cylinder 12 surrounding the first cylinder 11. In embodiments, the core further includes a third cylinder 13 surrounding the second cylinder 12. The first cylinder 11 has a radially outer surface 15 and a radially inner surface 14. Likewise, the second cylinder 11 has a radially outer surface 17 and a radially inner surface 16, and the third cylinder 13 has a radially outer surface 19 and a radially inner surface 18.

The core may further include a third cylinder surrounding the second cylinder. As with the other two cylinders, the third cylinder may have a radially outer surface and a radially inner surface and a plurality of through holes extending from the radially outer surface to the radially inner surface. The holes may increase in size from the radially inner surface to the radially outer surface. In embodiments, having three cylinders may help to enhance the breaking apart of the material. In embodiments, it may be particularly effective to rotate the first cylinder and the third cylinder in a first direction, and to rotate the second cylinder in the opposite direction. The opposite directions of rotation may favor the collisions between the material between the adjacent cylinders as well as helping to induce the water hammer effect, due to the change of direction in the flow of the working liquid. In embodiments, the first and third cylinders rotate in one direction, and the second cylinder rotates in the opposite direction. This sort of arrangement can increase the changes of direction of the working liquid and thereby can increase the number and intensity of shock waves.

In embodiments, the three cylinders may be rotated with different drives, although in other embodiments, the first and third cylinders may be rotated with a same drive, and the second cylinder may be rotated with another drive.

In embodiments, the core may further include additional cylinders, such as a fourth cylinder surrounding the third cylinder, and so on. It has been found that three cylinders offer a good balance between effectively producing nanoparticles and the use of materials and space for building and arranging the core with the cylinders. In embodiments, the first cylinder may have a radius of greater than or equal to about 150 mm, and the most outer cylinder may have a radius of about 2.5 m. One or more cylinders may be arranged between the inner and the outer cylinder.

In embodiments, the first cylinder 11 and the second cylinder 12 include a plurality of through holes 20 extending from the radially outer surface 15, 17 to the radially inner surface 14, 16. In embodiments, the holes 20 increase in size from the radially inner surface 14, 16 to the radially outer surface 15, 17 (see FIG. 2). In embodiments, the third cylinder 13 includes a plurality of through holes 20 extending from the radially outer surface 19 to the radially inner surface 18, and the holes 20 increase in size from the radially inner surface 18 to the radially outer surface 19.

In embodiments, the core includes at least one inlet for introducing the working liquid and the material into the core. The working liquid and the material may be introduced axially between the inner surface 14 of the first cylinder 11. In embodiments, the core includes one or more drives for rotating the first cylinder 11 and/or the second cylinder 12.

In embodiments, at least one of the first cylinder 11 and the second cylinder 12 may be rotated for accelerating the working liquid with the material and cause the working liquid and the material to travel radially outwards. In embodiments, the material may collide with itself, breaking apart and reducing in size. Cavitation and water hammer effects may arise, which may help the material to break down due to shockwaves and bubble collapse, as well as to increase the collisions of the material with itself due to increased turbulence.

As can be seen in FIG. 1, the first cylinder 11 and the second cylinder 12 (and in embodiments, additional cylinders 13) are hollow cylinders separated in a radial direction by a small distance. In embodiments, the cylinders are arranged concentrically. In embodiments, a distance between two cylinders may be about 10 microns to about 1 cm, such as about 10 microns, about 50 microns, about 100 microns, about 200 microns, about 300 microns, about 500 microns, about 1 cm, or any value contained within a range formed by any two of the preceding values. In embodiments, the distance may be the same between all the adjacent cylinders. In embodiments, the distance between the outer surface 15 of the first cylinder 11 and the inner surface 16 of the second cylinder 12 may be the same as a distance between the outer surface 17 of the second cylinder 12 and the inner surface 18 of the third cylinder 13. In embodiments, the distance between cylinders may be adjusted depending on several factors, for example, on which working liquid and material are to be introduced in the core, the density of the working liquid, the amount of the material, and other factors.

In embodiments, when at least one of the first cylinder and the second cylinder is rotated, the working liquid is accelerated, and a cavitation effect and a water hammer effect can be achieved for reducing a size of the material mixed in the working liquid. In embodiments, the cavitation effect and the water hammer effect also help to collide material with itself. When the working liquid is accelerated and passed through the first cylinder, between the first and the second cylinder, and through the second cylinder, low pressure regions may arise and vapor bubbles, also known as cavities or voids, may be formed in the low pressure regions. Some material may be trapped inside the bubbles. In particular, the vapor bubbles form when the pressure of the working liquid is reduced below the vapor pressure of the working liquid. When the bubbles reach regions of higher pressure, the bubbles can collapse and produce shock waves. In embodiments, the material inside and near the bubbles may therefore be reduced to a smaller size due to the shock waves and due to collision of the material with itself. Such a cavitation effect may specifically occur within and/or near the holes of the cylinders. The holes in the cylinders may promote the formation of bubbles.

In embodiments, when the working liquid is accelerated and its direction of flow changes suddenly, such as due the presence of the through holes, a pressure wave is produced. The pressure wave may help to break down the material as well as to increase collisions of the material with itself. In this regard, the pressure waves may cause a turbulent flow, which may enhance material collision. The water hammer effect, also known as hydraulic shock, may therefore also help to reduce a size of the material inside the working liquid.

In embodiments, the rotation of at least one of the cylinders may also cause the material in the working liquid to collide against itself, thereby reducing its size. In particular, if the first cylinder and the second cylinder are rotated in opposite directions, the working liquid between the two cylinders moves in the direction of rotation of the first cylinder in a region close to the first cylinder and moves in the direction of rotation of the second cylinder in a region close to the second cylinder. In embodiments, collisions between the material will be promoted where the two regions meet.

Figure 2:
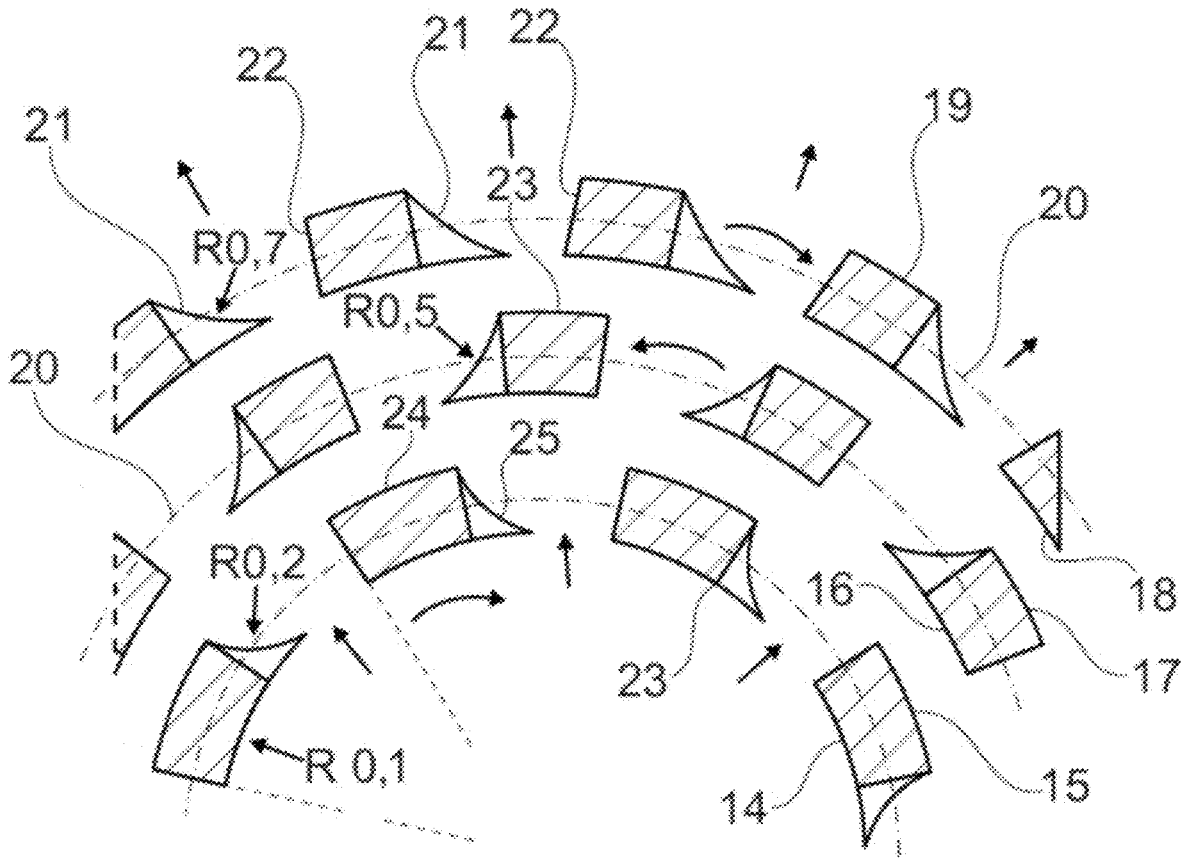
FIG. 2 schematically illustrates an enlarged cross-sectional view of an example of three cylinders for accelerating a working liquid comprising a material, according to an embodiment of the present disclosure.

FIG. 2 schematically illustrates an enlarged cross-sectional view of an example of three cylinders. In embodiments, the cross-section is taken perpendicular to the axial direction of the cylinders. In embodiments, the through holes 20 may be delimited by a first curved edge 21 and a second straight edge 22 in a cross-section perpendicular to an axial direction of the first cylinder 11 and the second cylinder 12. In embodiments, the curved edge 21 may be configured to direct the flow of the working liquid radially outwards and be configured to scoop the working liquid and direct it radially outwards. The curved edge 21 may be concave, such that the curved edge may curve inwards.

In embodiments, as the through holes increase in size towards the radially outer surface of the cylinders, the pressure may be higher at the radially outer surface of a cylinder than at the radially inner surface of the cylinder.

Therefore, the movement of the working liquid through the cylinder radially outwards is promoted when rotating the cylinder.

In embodiments, at least some of the through holes of the first cylinder may face at least some of the through holes of the second cylinder, in particular in a radial direction. Although this may not be necessary for colliding the material with itself and achieving the water hammer and cavitation effects, the flow of the working liquid between cylinders may be facilitated and the water hammer and cavitation effects may be enhanced. Nanoparticle production may be more effective in this manner.

In embodiments, the first cylinder and the second cylinder may be separated by a distance of about 10 microns to about 1 cm, such as about 200 microns to about 2 mm, or any value contained within a range formed by any two of the preceding values. These distance ranges may be particularly favorable for achieving the cavitation and water hammer effects, and for enhancing the collision of the material with itself and breaking apart the material efficiently. The distance between the first cylinder and the second cylinder may be selected at least based on the diameter of the cylinders.

In embodiments, at least some or all of the through holes may be arranged in rows extending in a circumferential direction of the first cylinder and the second cylinder. This arrangement may facilitate building the cylinders and enhancing the production of nanoparticles, specifically if the rows of the first cylinder face the rows of the second cylinder. In embodiments, at least some of the through holes of the first cylinder and the second cylinder may be arranged in rows that overlap in a radial direction, wherein a row of through holes of the first cylinder has substantially the same axial position as a row of through holes of the second cylinder. The movement of the working liquid towards and through the second cylinder may therefore be facilitated. In embodiments, a distance or a pitch between the adjacent holes of a row may be the same for the row. In embodiments, the pitch may be the same for all the rows of a specific cylinder. In embodiments, the first and second circumferential rows have a constant pitch within a row. Similarly, the through holes of a cylinder may be arranged in columns along an axial direction of the corresponding cylinder.

In embodiments, a distance between each of the plurality of through holes of the second cylinder, which may be measured along a circumferential direction, may be larger than a distance between each of the plurality of through holes of the first cylinder along a circumferential direction. This arrangement may help to move the working liquid radially outwards.

In the embodiment of FIG. 2, the first cylinder 11 and the third cylinder 13 are configured to be rotated clockwise. Therefore, the curved edges 21 face a clockwise direction. In embodiments, the vertex of the cylinder portions 23 at the radially inner surface 14, 18 point clockwise. In embodiments, the second cylinder 12 is to be rotated counterclockwise. Therefore, the curved edges 21 of the cylinder portions 23 of the second cylinder 12 face a counterclockwise direction. In embodiments, the vertex of the cylinder portions 23 at the radially inner surface 16 point counterclockwise. In this cross-sectional view, a cylinder portion 23 may include a first subportion 24 and a second subportion 25. In embodiments, the second subportion 25 includes the curved edge 21 delimiting a through hole 20, whereas the first subportion 24 includes the straight edge 22 delimiting another through hole 20.

In embodiments, the through holes may be delimited by a first side edge and a second side edge in a cross-section perpendicular to an axial direction of the first cylinder and the second cylinder. The first side edge may be curved, and the second side edge may be straight. The curvature of the cylinder between its radially inner and outer surfaces promotes moving the working liquid through the through holes and radially outwards. In particular, these curved surfaces may behave as leading edges. The curved edge may help to promote and enhance the water hammer effect.

In embodiments, the first edge 21 and/or the second edge 22 may have different shapes. For example, the first edge 21 may also be straight, but an edge curved inwards 21 may help to direct the working liquid radially outwards as well as to enhance the water hammer effect.

In embodiments, the radius of curvature of the curved edges 21 may increase from the first cylinder 11 to the second cylinder 12, and so on. A radius of curvature may for example be between about 0.1 mm and about 0.5 mm.

In embodiments, the through holes 20 may have a substantially elliptical cross-section. This cross-section may be taken perpendicular to a radial direction. At an outer surface 15, 17, 19, a major axis of the ellipse may be between 3 and 10 mm, and a minor axis of the ellipse may be between about 1 mm and about 5 mm in some examples. An elliptical cross-section of the through holes 20 may be particularly suitable for achieving and enhancing the water hammer and cavitation effects. Other shapes of a cross-section of a through hole 20 may be possible. For example, a cross-section of a hole 20 may be oval, oblong, or circular, in some embodiments.

In embodiments, the shape and dimensions of the through holes 20 may be adapted to the working liquid to be used, and in particular to the type and size of the material mixed with the working liquid. In embodiments, the shape and internal dimensions of the through holes 20 may be varied considering that a speed of a hole increases with an increasing distance to the center of the first cylinder 11.

In embodiments, a size of the through holes (in particular in a circumferential direction) of the cylinders 11, 12, 13 may decrease from the most radially inner cylinder 11 to the most radially outer cylinder 13. A through hole may for example have a radius of about 1 mm to about 12 mm. Although it may depend on the number of cylinders used, a most radially inner cylinder may have a radius between 10 mm and 12 mm, and a most radially outer cylinder may e.g. have a radius between 0.5 mm and 2 mm, in embodiments. In embodiments, a radius of the holes (in the largest cross-section and along the direction in which the hole is larger) may reach up to 12 mm.

In embodiments, at least some of the through holes 20 of the first cylinder 11 and the second cylinder 12 may be arranged in rows 26 that overlap in a radial direction (see FIG. 1). In embodiments, a row extends in a circumferential direction of the corresponding cylinder. In embodiments, the axial position of one or more of the rows of the first cylinder may coincide with the axial position of one or more rows of holes of the second cylinder. In embodiments, the movement of the working liquid towards and through the second cylinder (and additional cylinders) may be facilitated. In embodiments, the through holes 20 may also be arranged in columns 27. In embodiments, a column extends in an axial direction of the corresponding cylinder.

In embodiments, a distance or pitch along adjacent through holes 20 of the second cylinder 12 may be larger than a distance between adjacent through holes 20 of the first cylinder 11. This pitch may be measured in circumferential direction. In embodiments, a pitch between adjacent through holes increasing for the cylinders when moving in a radially outwards direction may help to move the material radially outwards. In embodiments, a pitch between two adjacent through holes 20 may be about 5 mm to about 10 mm.

In embodiments, the core includes one or more inlets through which the working liquid containing the material, or the material and the working liquid separately, may be introduced.

In embodiments, the core further includes a housing enclosing at least the first cylinder 11 and the second cylinder 12. The housing may form a chamber in which the first cylinder 11 and the second cylinder 12 are arranged. Any suitable coupling between the cylinders 11, 12, 13 and a mechanism for rotating the cylinders, for example a shaft, or between the cylinders 11, 12, 13 and the housing may be provided. In embodiments, the housing may include one or more elements, such as conduits or tubes, for introducing one or more fluids, such as gases, which may be mixed with the working liquid. The housing of the collider may also include one or more elements for adjusting one or more conditions in the core. For example, temperature and pressure within the core may be adjusted with suitable elements or tools. These elements or tools may also be provided separate from the core.

As a working liquid is to be introduced in the core, the core should be working liquid tight for avoiding leakages and damage to the surrounding elements of the apparatus. In embodiments, a non-contact coupling between a drive for rotating a shaft and the shaft connected to one or more cylinders may be provided. In embodiments, a suitable non-contact coupling may be a magnetic coupling. A magnetic coupling may for example include permanent magnets or electromagnets. A non-contact coupling may help to avoid or at least reduce the risk of having working liquid or humidity leaking from the core reaching and damaging the drive. As lubricants may be dispensed due to less friction due to the non-contact coupling, a non-contact coupling may also help the apparatus to have a smoother operation and to transfer the energy from the drive to the shaft more efficiently. Other suitable couplings between a drive and a shaft may be gear and belt transmissions. These transmissions may also allow a precise control of the rotational speed of each cylinder. One or more gearboxes may be provided for driving each cylinder at a desired rotational speed.

In embodiments, a drive may be provided for rotating a shaft, and therefore rotating the corresponding cylinder(s). The drive may be directly or indirectly connected to a corresponding shaft. In embodiments, a connection to a corresponding shaft may be through a hydraulic coupling system, a pneumatic system, or a non-contact system such as a magnetic coupling system. For example, a magnetic coupling may be provided between a drive and a shaft. Bearings, for example ceramic bearings, may be arranged with the shaft.

In embodiments, the drive may be an electric motor. The motor may be AC motor, a brushless DC electric motor, or in general any suitable motor for rotating the shaft. Other suitable actuators for rotating the shaft may alternatively be provided. In embodiments, a gas turbine, an air turbine, or a steam turbine may be used as a drive. The one or more drives may be arranged outside the core and the coupling with the shaft may be a non-contact coupling, such as a magnetic coupling, so as to avoid or at least reduce any contamination of the drive.

In embodiments, the apparatus may include one shaft connected to the cylinder(s) to be rotated in one direction, and another shaft connected to the cylinder(s) to be rotated in the opposite direction. Each shaft may be provided at opposite ends of the core of the apparatus.

In embodiments, at least one the cylinders 11, 12, 13 may be rotatable, or all the cylinders may be rotatable. Alternating cylinders may be rotated in a same direction. For example, the first 11 and the third 13 cylinders may be rotated in the same direction opposite to a direction of rotation of the second cylinder 12. In embodiments, two adjacent cylinders may be rotated in a same direction, at the same or at different speeds of rotation.

In embodiments, the cylinders 11, 12, 13 may be arranged in a horizontal configuration (rotation about a horizontal axis, wherein the axial direction is parallel to the horizontal axis). In embodiments, the cylinders may be arranged in a vertical configuration (rotation about a vertical axis), or in a different configuration.

In embodiments, the working liquid may be axially introduced into the core and the first cylinder 11, such as through a shaft for rotating the first cylinder 11. In embodiments, the housing of the core may include one or more exits for the working liquid with the material of smaller size. In embodiments, the cylinders 11, 12, 13 may include a ceramic material. Using a ceramic material may help to operate with materials which may exhibit magnetism. The cylinders may be coated with a ceramic material in some examples. The cylinders may have a cylinder body made of steel, such as stainless steel, and a ceramic coating. In embodiments, other materials for the cylinder body and for a coating, if present, may be used. For example, a cylinder may include a wolfram carbide coating, in embodiments.

During operation, the core may reach high temperatures, for example temperatures above 100° C. In embodiments, a cooling system may be provided for cooling the core. For example, the housing may include conduits through which a suitable cooling fluid may be circulated.

In embodiments, the core may further include a plurality of grinding balls within the first cylinder 11. If the grinding balls are present, a size of the material introduced in the first cylinder 11 may be larger, and the grinding balls may reduce the material's size until the material is small enough to enter the through holes of the first cylinder 11. In this manner, if the material within the working liquid is not small enough to advance radially outwards through the holes of the first cylinder because the material is too big for those holes, the grinding balls will reduce its size until it can go through the first cylinder. Therefore, the initial size of the material within the working liquid may vary, as the material may be broken down by the grinding balls. In embodiments, the efficiency in breaking down the material may be increased when grinding balls are present. The size, weight, and number of grinding balls may be selected according to the radius of the first cylinder as well as the rotational speed to be applied to the first cylinder.

In embodiments, the core may be incorporated in an apparatus. According to a further embodiment, an apparatus for obtaining particles from a material is provided. A schematic example of an apparatus is provided in FIG. 3.

Figure 3:
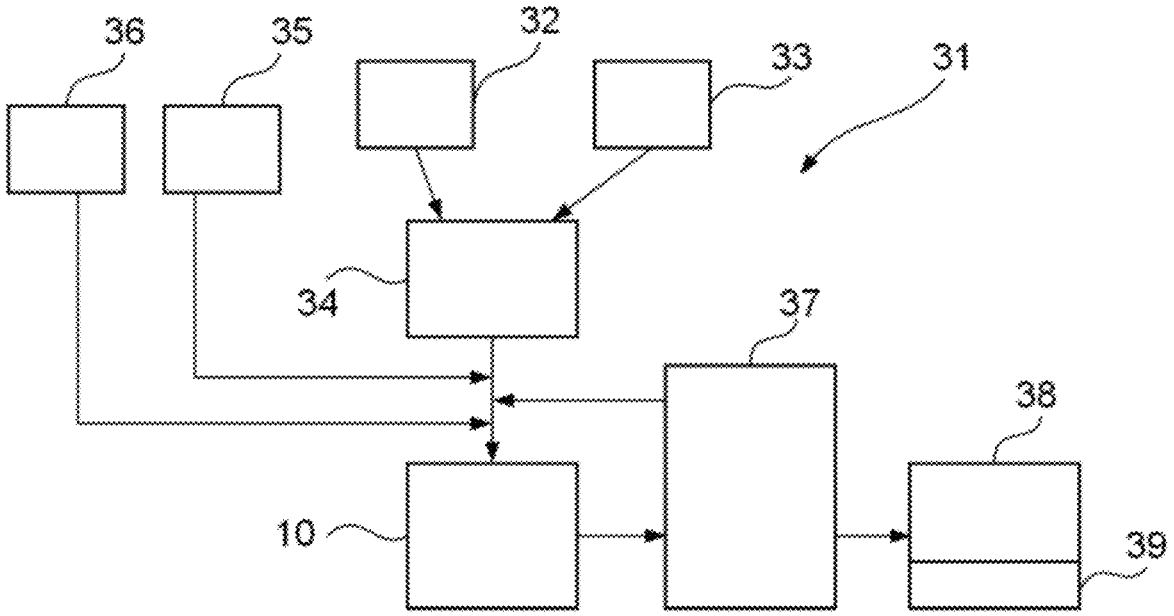
FIG. 3 schematically illustrates an apparatus including a core according to the disclosure, according to an embodiment of the present disclosure.

In embodiments, the apparatus 31 includes a core 10 as described throughout this disclosure and one or more inlets for introducing the working liquid and the material in the apparatus. In embodiments, the material and the working liquid can be introduced to the apparatus together or separately. In the example of FIG. 3, the working liquid and the material are introduced separately, see the two separate containers 32, 33 for the working liquid and the material. The material may be provided in powder form, in embodiments. The apparatus may further include a mixing chamber 34 for mixing the material and the working liquid. Mixing may be performed with any suitable mixing element or stirrer, such as a magnetic stirrer.

In embodiments, the apparatus 31 may be configured to dose the working liquid containing the material to be introduced in the core 10. In embodiments, the apparatus 31 may include a suitable system for dosing the working liquid. For example, one or more valves may be used. In embodiments, the apparatus may further include valves in other portions of the apparatus for regulating the flow of the working liquid through the apparatus.

In embodiments, the apparatus may include a system for introducing one or more fluids (in the form of liquids or gases) for controlling, or setting, an atmosphere within a path of the apparatus through which the material is to travel. For example, the system may be configured to introduce a fluid in the apparatus for modifying an atmosphere within the apparatus. In embodiments, a fluid such as nitrogen may help to maintain a controlled level of oxygen during the production of the nanoparticles. A fluid such as argon may help to create a controlled environment for certain processing conditions. Other suitable fluids may be used. For example, the system may be configured to provide liquid nitrogen, which may help to achieve low temperatures. In some examples, the system may include a vacuum pump for creating vacuum conditions. The example of FIG. 3 schematically illustrates a storage container 35 for a fluid and a vacuum pump 36.

In embodiments, the fluid may be introduced into different portions of the apparatus 31. For example, the fluid may be introduced in a conduit of the apparatus or in another portion of the apparatus. In embodiments, the fluid may also be directly introduced in the core 10.

Conditioning of the atmosphere may be provided before the working liquid containing the material is introduced into the core 10 for the first time, in embodiments. In embodiments, vacuum may be applied, and then a fluid such as nitrogen or argon may be introduced in the apparatus 31. The working liquid may be introduced in the apparatus once a desired atmosphere has been created. For example, one or more fluids may be introduced in the apparatus, such as in a conduit thereof, for controlling an atmosphere through the travel path of the working liquid containing material. In embodiments, the same or a different fluid may be directly introduced in the core 10 once the working material is inside the apparatus, for example inside the core.

As previously indicated, the apparatus 31 may also include one or more drives for rotating at least one of the first cylinder 11 and the second cylinder 12. A drive may for example be a motor.

In embodiments, the apparatus 31 may further include a system for generating a vacuum for removing the working liquid with material of smaller size from the core 10. In particular, the system may be configured to create a vacuum in an outlet of the core 10.

In embodiments, the material of smaller size may be separated from the working liquid after leaving the core 10. The apparatus 31 may include a system 37 for separating the material from the working liquid. An example of such a system may be a centrifugal separator. System 37 may be configured to separate material by size or density in some examples. The system 37 may separate the material within the working liquid in two or more groups according to size of the components of the material.

In embodiments, the system 37 for separating the material from the working liquid and the system for generating a vacuum for removing the working liquid with the material from the core 10 may be the same.

In embodiments, after leaving the core 10, the material may include a portion of nanoparticles which have a desired size and are therefore ready to be collected, and may include a portion of nanoparticles or material of a larger size which have not yet reached the desired size. In embodiments, the nanoparticles which are ready may be directly removed from the apparatus 31. In embodiments, the apparatus 31 may include a collection system 38 configured to collect the nanoparticles which have reached a desired size. Such a collection system 38 may include an element configured to suck the nanoparticles towards an inside of the system 38. The nanoparticles may for example go from the centrifugal separator 37 to the collection system 38. The system 38 may include a storage element 39, from which the nanoparticles may be removed. In some examples, the storage element 39 may be removable from the collection system 38.

In embodiments, the portion of the material which has not reached a desired sized may be directed to the core 10 to be collided again, from the centrifugal separator 37. In embodiments, the apparatus 31 may be configured to this purpose. In embodiments, the working liquid may also be directed to the core 10 after it has been separated from the material.

In embodiments, the nanoparticles may be processed further after they have been produced. In other examples, the nanoparticles may be directly packed after their production. In embodiments, the apparatus 31 may include a suitable system for packing the produced nanoparticles in a suitable manner. In embodiments, the apparatus 31 may include a container-based system, including for example glove boxes, for packing the produced material. In embodiments, the apparatus may be arranged in a clean room. The clean room may include one or more systems for controlling the quality of the air, for example for filtering the air. Blankets such as water blankets may be provided for air filtration.

In embodiments, the apparatus may further include a plurality of valves. The valves may regulate the passage of the working liquid fluid through a path of the apparatus and may be selectively and controllably opened and closed for suitably operating the apparatus. Valves may help to control a flow through a fluid path within the apparatus. In embodiments, the apparatus may further include one or more pumps for moving the working fluid through the apparatus. For example, centrifugal pumps, membrane pumps, tesla pumps, or combinations thereof may be used In embodiments, the apparatus may further include one or more pressure compensators, and/or one or more pressure expanders. The apparatus may further include one or more pressure compensators, and/or one or more pressure expanders.

In embodiments, the apparatus may further include one or more heaters such as microwave heaters, plasma heaters, or induction heaters. In embodiments, one or more heaters may be provided in the separator system 37 for helping to dry the material.

Figure 4:
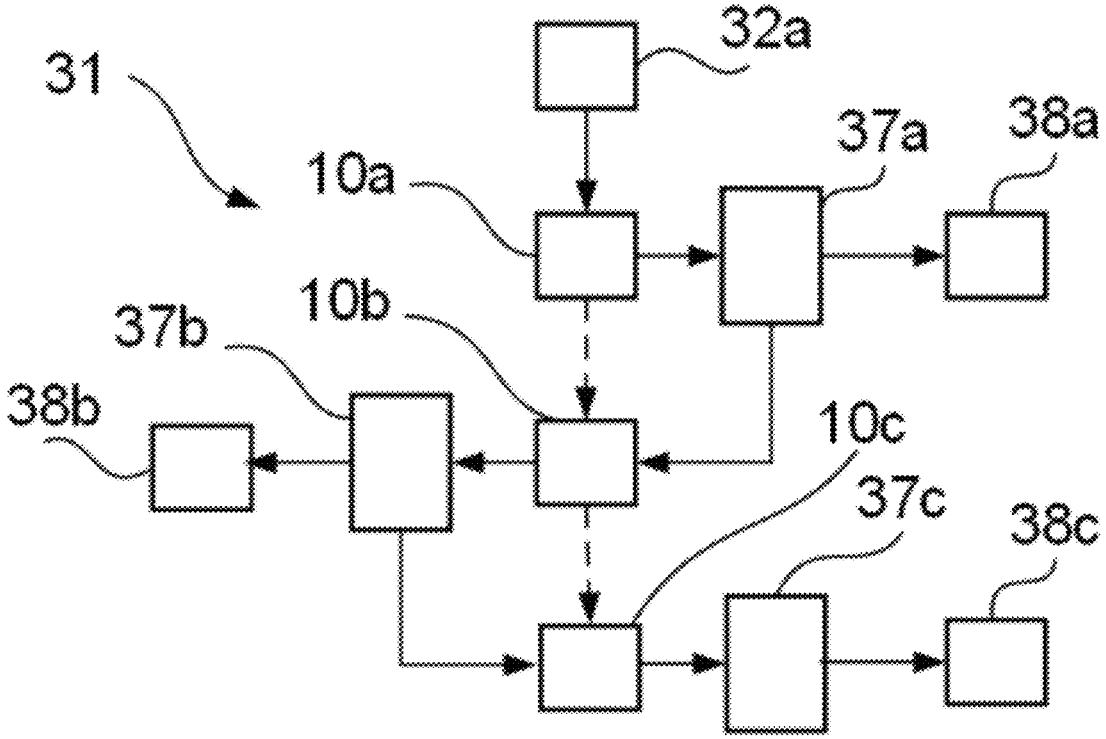
FIG. 4 schematically illustrates another example of an apparatus, the apparatus including a plurality of cores, according to an embodiment of the present disclosure.

In embodiments, an apparatus may include more than one core. FIG. 4 schematically illustrates an example of an apparatus 31 which includes a plurality of cores 10, in particular three cores. Therefore, three stages may be provided: at the first stage, the working liquid including material is introduced into a first core 10*a*. Once the material has been made smaller, the working liquid is introduced into a first centrifugal separator 37*a*. The material which has a desired size is collected at a first collector system 38*a*. At the second stage, the material from the first stage which has not achieved a desired size and the remaining working liquid are introduced into a second core 10*b*. The working liquid with the material is then passed through a second centrifugal separator 37*b*. The material which has reached a desired size is collected at a second collector system 38*b*. At the third stage, the material not yet having a desired size is introduced into a third core 10*c* with remaining working liquid from the centrifugal separator 37*b*. The material is then separated from the working liquid once more in a third centrifugal separator 37*c*. The material which is ready is collected in a third collector system 38*c*. A plurality of drives such as electric motors may be used for rotating the first and second cylinders of each core.

In embodiments, the working liquid may be circulated through all or some of the available cores. In embodiments, if necessary, after the material and the working liquid have been circulated through all the available cores, the working liquid may be circulated through one or more of them again. Likewise, nanoparticles may be collected after the working liquid is passed through a corresponding core. For example, the working liquid may be circulated through more than one core before nanoparticles are collected (see for example the dashed lines of FIG. 4).

In embodiments, the apparatus 31 may include or may be connected to one or more storage containers 32*a* that store the working liquid and the material, either jointly or separately. In the example of FIG. 4, a single container 32*a* including the working liquid and the material is provided.

In embodiments, one or more of the centrifugal separators 37*a*, 37*b*, 37*c*, or an additional centrifugal separator arranged after the third centrifugal separator 37*c*, may include a plurality of ultrasound generators. The ultrasound generated by the ultrasound generators may help to palletize the produced nanoparticles. A pallet may have dimensions of a few microns, that is, a length of a pallet may be below 20 microns, in embodiments. A plurality of pallets may be stored in a cartridge.

In embodiments, the apparatus 31 may further include a plurality of sensors, for example flow sensors, temperature sensors, humidity sensors, pressure sensors, rotational speed sensors, or combinations thereof. The operation of the sensors may be controlled using a sensor control system. A control unit may control the operation of the apparatus 31 during the production of nanoparticles based on real-time data obtained by the sensors.

Aspects of the apparatus of FIG. 4 may be applied and combined with the apparatus of FIG. 3, and vice versa. For example, one or more ultrasound generators may be included in the apparatus of FIG. 3 for palletizing the produced nanoparticles. In embodiments, one or more tanks with fluids for conditioning or setting the atmosphere inside the apparatus may also be provided in the apparatus of FIG. 4.

Suitable drives or actuators may be provided for rotating at least one of the cylinders. For example, one or more motors, a gas-powered system, an electromagnetically powered system and others may be used for causing rotation. In embodiments, a flywheel may be connected to the cylinder (s) to be rotated for reducing stress during operation.

In embodiments, at least one of the cylinders may be rotated with a hydraulic system or a pneumatic system. In embodiments in which a pneumatic system is provided to rotate a cylinder, a gas which is, or will be, introduced into the core may also be a gas which is used to drive the cylinder, and the core may be slightly under pressurized with respect to the pneumatic system. In this manner, leakage of the working liquid inside the core may be avoided or at least reduced due to the pressure difference between the core and the pneumatic system. If gas from the pneumatic system enters the core, contamination may be avoided as the gas in the pneumatic system and inside the core may be the same. In embodiments, two tanks of a same gas, such as an inert gas or any suitable gas, may be provided. Gas from one of the tanks may be introduced into the core such that the gas is dissolved within the working liquid, while gas from the other tank may be used to drive the pneumatic drive. In embodiments, the pneumatic system may include a turbine and a compressor, such that the gas from the corresponding tank may be compressed and used to move the turbine, and therefore to move the corresponding shaft and cylinder.

In embodiments, the working liquid, optionally containing already the material, may therefore be introduced in the apparatus and guided to the core. Also, the working liquid with the material of smaller size may be extracted from the core and guided away from the core through the apparatus.

In embodiments, as the working liquid progresses through the cylinders and through holes and moves radially outwardly, the temperature of the working liquid can increase. In embodiments, at the outer circumference of the outer cylinder of the core, all or some of the working liquid may have been converted to steam, vapor, or gas.

Methods of Producing Nanoparticles

In embodiments, a core as described herein and an apparatus as described herein may be used to produce nanoparticles. In embodiments, there is provided a method of producing nanoparticles of a material in a working liquid, including: introducing the material and the working liquid into the core of the apparatus as described herein; rotating the first cylinder, the second cylinder, or a combination thereof; accelerating the working liquid to cause a cavitation effect; and changing a flow direction of the working liquid to cause a water hammer effect; thereby producing nanoparticles of the material.

Figure 5:
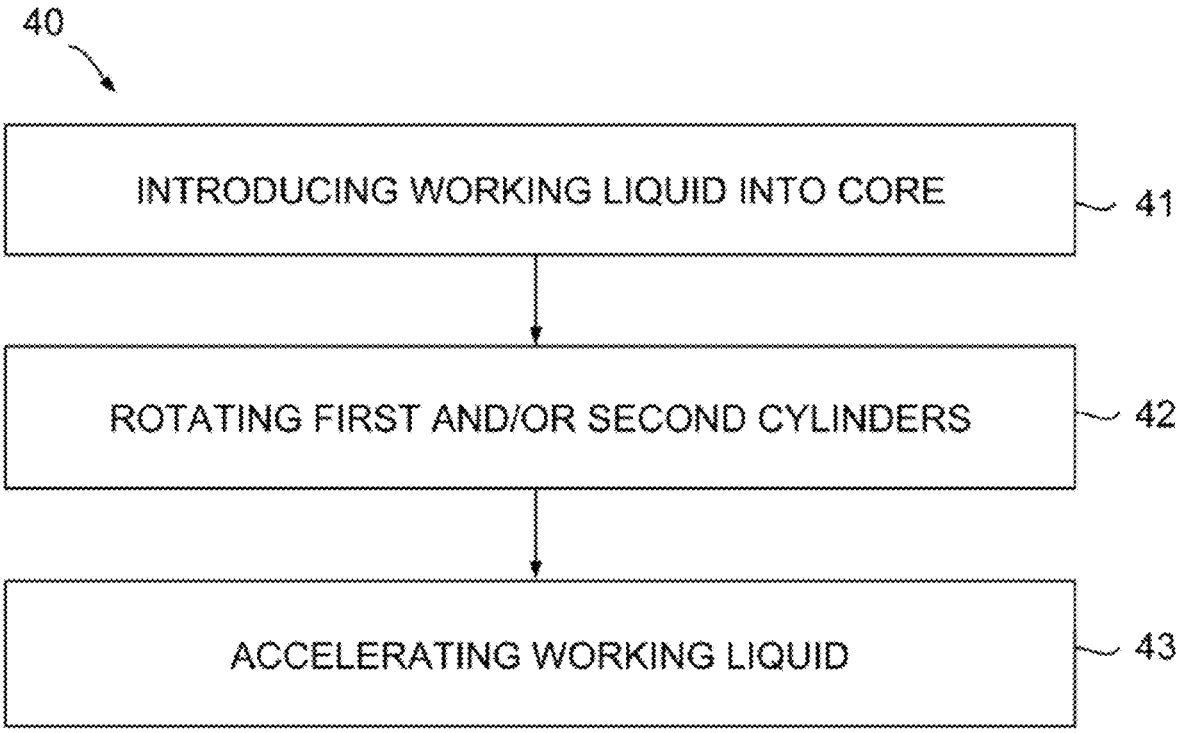
FIG. 5 schematically illustrates a flowchart of a method for producing nanoparticles with an apparatus, according to an embodiment of the present disclosure.

The method is schematically illustrated in the flowchart of FIG. 5. The explanations and details provided before with respect to the core and the apparatus can be applied to the method, and vice versa.

In embodiments, the method 40 includes, at block 41, introducing a working liquid including a material into a core 10 as described throughout this disclosure. In embodiments, the method further includes, at block 42, rotating the first cylinder 11 and/or the second cylinder 12 of the core 10. In embodiments, the method further includes, at block 43, accelerating the working liquid to cause a cavitation effect and a water hammer effect such that nanoparticles of the material are produced.

In embodiments, the collisions between the material as well as the pressure waves and bubble collapse due to the water hammer and cavitation effects may help to effectively obtain material of smaller size, in particular nanoparticles.

In embodiments, the steps of introducing 42 the working liquid in the core 10 and rotating 41 the first cylinder 11 and/or the second cylinder 12 may be performed one after the other or at overlapping periods of time, that is, simultaneously. For example, one or more cylinders of the core may be rotated first for helping to introduce the working liquid in the core. In embodiments, the working liquid may be introduced in the core first, and then one or both cylinders may be rotated.

In embodiments, the working liquid may be a dispersion or a slurry. In embodiments, the working liquid may include one or more gases. In embodiments, one or more gases may be mixed with the working liquid inside the apparatus, for example inside the core. The working liquid may include water, or other working liquids may also be used. For example, fuels such as diesel, bio diesel, and gasoline may also be used as working liquid. The material within the working liquid may preferably be micron sized, that is, a few or tens or hundreds of microns. The material may also have other suitable sizes, such as less than one micron. It may also be possible to have material with a size of a few millimeters. As previously mentioned, grinding balls may be provided for reducing the material to a size suitable to go through the first cylinder. In embodiments, the working liquid may include minerals, salts, biological material, or combinations thereof. The working liquid may include catalysts or additives such as carbon, nickel, potassium hydroxide, and others. The apparatus of the current present disclosure may be able to operate with additional materials, a broader range of material sizes, and increased amounts of material than previously available technologies.

In embodiments, the working liquid and the material may be introduced into the apparatus together. In embodiments, the working liquid and the material may be introduced separately in the apparatus, and mixed in the apparatus before feeding it to the core, and in particular between the radially inner surface of the first cylinder. In embodiments the apparatus may include one or more mixing chambers in which the material may be mixed with the working liquid. A magnetic stirrer, or in general any suitable stirrer or element, may be used to mix the working liquid and the material.

In embodiments, both cylinders may be rotated (or more cylinders if the apparatus includes more than two cylinders, such as three cylinders). For example, the drives may be configured to rotate the first cylinder in a first direction and the second cylinder in a second direction opposite to the first direction. This configuration may help to promote collisions of the material within the working liquid. In embodiments, both cylinders may be rotated, but at different rotational speeds. In embodiments, one of the cylinders may be rotated, while the other is static, that is, not rotated. Rotation of at least one cylinder may be performed at over 500 revolutions per minute (rpm) in some examples, such as greater than or equal to about 10,000 rpm, such as about 50,000 rpm, about 70,000 rpm, about 100,000 rpm, and so forth, or any value contained within a range formed by any two of the preceding values.

In embodiments, the collisions between the material, as well as the pressure waves and bubble collapse due to the water hammer and cavitation effects, may help to effectively obtain the material in a smaller size, in particular nanoparticles of the material.

In embodiments, the working liquid, optionally containing already the material, may therefore be introduced in the apparatus and guided to the core. In embodiments, the working liquid with the material of smaller size may be extracted from the core and guided away from the core through the apparatus.

In embodiments, the method may further include using a separator system for separating the material from the working liquid. Such a system may for example be a centrifugal separator. In embodiments, the separator system may be configured to generate a vacuum for removing the working material from the core. Other systems, such as a system including gravity separation or a system including electropotential separation (using static electricity), may also be used.

In embodiments, once the nanoparticles have reached a desired size, they may be removed from the apparatus. In embodiments, the nanoparticles may be collected in a collection system included in the apparatus, and then removed from the apparatus. The collection system may, in embodiments, include one or more glove boxes, such as hermetically sealed enclosures for ensuring stability, providing a controlled environment for the nanoparticles, and avoiding contamination. A collection system, which may include one or more valves, may be connected to the outlet of the separator system. If the apparatus includes a plurality of cores, a plurality of collection systems may be provided, and the collection systems may be connected to the outlets of a plurality of separator systems, such that nanoparticles may be collected and packaged, for example palletized, after the working liquid has been removed from each core.

In embodiments, the method may include passing the material through the core more than once. If after a colliding process in the core, there is material which does not have the desired dimensions, the material which does not yet have the desired size may be directed through the core again. This process may be repeated a plurality of times.

In embodiments, the method may further include generating a vacuum or reduced pressure for removing the working liquid from the core once the material has a smaller size. After passing through the core, the working liquid may have a high proportion of gas, vapor, or steam. A suitable and efficient manner for removing the working liquid and/or gas from the core may include the use of a vacuum. A vacuum may herein be regarded as a significantly lower pressure than the working pressure in the core.

In embodiments, a vacuum may also be generated for preparing an atmosphere inside the apparatus before introducing the working liquid. For example, an inside of the apparatus may be washed and then vacuum may be applied for achieving a suitable atmosphere in the apparatus before introducing the working liquid. In embodiments, one or more gases, such as inert gases, may be introduced into the apparatus for preparing the atmosphere. In embodiments, the level of oxygen inside the apparatus may also be controlled.

In embodiments, the method may further include controlling or setting an atmosphere within a path of the apparatus through which the working liquid is to travel. For example, the system may be configured to introduce a fluid, in the form of a liquid or a gas, into the apparatus for modifying an atmosphere within the apparatus. Introducing nitrogen may help to regulate a level of oxygen within the apparatus. Argon is another fluid which may help to create a desired and controlled environment, in embodiments. In embodiments, the system may additionally or alternatively be configured to create vacuum within the apparatus. For example, a vacuum pump may be provided. A controlled suitable atmosphere for the production of nanoparticles may be achieved. In embodiments, the apparatus may further include a drying system and/or a dehumidifying system.

In embodiments, the method may further include using a controller configured to control, manage, or coordinate the operation of the apparatus. In embodiments, the controller may have one or more processors and one or more memories with instructions which may be executed by the one or more processors. In embodiments, the apparatus may further include a plurality of sensors which may be communicatively coupled (through wires or wireless) to the controller. Examples of sensors may be temperature sensors, humidity sensors, pressure sensors, or combinations thereof. In embodiments, the measurements of the sensors may help to precisely control and adjust the operation of the apparatus in real time.

In embodiments, the apparatus may be configured to generate hydrogen ($H_2$) inside it. An example of the use of an apparatus to generate hydrogen can be found in European Patent Application No. 23383307, which has been filed as U.S. patent application Ser. No. 18/589,002, both of which are incorporated by reference herein in their entirety. In embodiments which produce hydrogen, the working liquid may be water, such as seawater, and the material may be an oxidizable metallic material. In embodiments, hydrogen gas and nanoparticles may be simultaneously produced. Colliding the material, which may include an oxidizable metallic material, may activate the material such that the produced nanoparticles are able to react with water molecules, in particular without adding a base such as potassium or sodium hydroxide (KOH and NaOH). Alkaline water may also be used but is not required. An oxidizable metallic material as described herein may include both metals such as iron, aluminum, calcium, magnesium, zinc, and the like, as well as metalloids such as silicon. In embodiments, the oxidizable metallic material may further include a non-metallic compound. In embodiments, the oxidizable metallic material may include oxides of the metals or metalloids described herein. For example, the oxidizable metallic material may include $Al_2O_3$, $FeO_2$, or MgO.

In embodiments, the reaction between the material, which can include a metal, and water may produce a hydroxide in addition to hydrogen gas. By colliding the metals, or other suitable oxidizable metallic materials, in presence of water, hydroxides may be obtained. For example, for aluminum, calcium, magnesium, and zinc, the following reactions with water may occur, respectively:

$$2Al+6H_2O \rightarrow 2Al(OH)_3+3H_2$$

$$Mg+2H_2O \rightarrow Mg(OH)_2+H_2$$

$$Ca+2H_2O \rightarrow Ca(OH)_2+H_2$$

$$Zn+2H_2O \rightarrow Zn(OH)_2+H_2$$

In embodiments, additives may be added for improving the reaction between the oxidizable metallic material and the water. For example, the addition of additives including silicon, graphene, activated carbon, or combinations thereof may help to improve the reaction between the material and the water. Such additives may also be included in the oxidizable metallic material. For example, the oxidizable metallic material may include nano-sized activated carbon or graphene. An oxidizable material may herein refer to a material which is capable of removing and capturing oxygen from a water molecule, such that hydrogen is produced in the process. Other additives that may be used are, for example, iron nanoparticles or nickel.

In embodiments, the use of nickel may help to weaken the bonds between the hydrogen and the oxygen of the water molecules due to bonding of the nickel to the hydrogen atoms of the water molecules. Nickel may therefore help to promote the reaction between the oxidizable material and the water molecules. Additionally, nickel may help to break the water molecules, wherein the hydrogen atoms remain attached to the nickel. Accordingly, the hydrogen production may also be enhanced.

In embodiments, nickel may be introduced in the core in powder form. In other embodiments, nickel may be attached to an inside of the apparatus. For example, strips or other suitable elements including nickel, made of nickel, or coated with nickel may be attached to the apparatus. A suitable location may be at the outlet of the core, such that the working liquid (which can include water) and the nanoparticles of the material after traveling through the core may be passed and contacted with the nickel.

Therefore, in embodiments, an oxidizable material may be collided for obtaining nanoparticles which may react with water, for example seawater, without the need to use further reactants. Such a reaction may effectively produce hydrogen. For example, if silicon is used, the nanoparticles of silicon produced may undergo the following reaction: $Si+4H_2O \rightarrow Si(OH)_4+2H_2$. Hydrogen gas is therefore produced. The silanol functional groups (Si—OH) of the orthosilicic acid ($Si(OH)_4$) may then form siloxane bonds (Si—O—Si) and release water: $2Si(OH)_4 \rightarrow (OH)_3Si—O—Si(OH)_3+H_2O$. Subsequently, the released water molecules may react with the silicon nanoparticles which have not reacted yet, sustaining the production of hydrogen gas until the silicon nanoparticles have been consumed: $4H_2O+Si \rightarrow Si(OH)_4+2H_2$.

In embodiments, the chemical reactions above may cause the pH to decrease, and a decrease in pH can increase the kinetics of the reaction. For example, a pH below 5 may help to speed up the process as well as to increase the reactivity of the silicon nanoparticles. However, this reactivity will depend on which additive(s) in which amount (if additives are added at all). It may also be possible that the pH increases, in embodiments. In embodiments, an acidic solution, such as one including orthosilicic acid ($Si(OH)_4$), may be added to accelerate the process for generating hydrogen gas.

Besides seawater, water such as tap water, deionized water, extra pure water, grey water, waste water, contaminated water, sewage water, water including oil, or other types of water may be used in the present method.

In embodiments, hydrogen may be produced in the separator system, for example in a centrifugal separator. The hydrogen may be collected from the top of the centrifugal separator and a remaining working liquid may be collected from the bottom of the centrifugal separator. Remaining material and working liquid may be directed to the core. Hydrogen may also be produced in, and collected from, the core, in embodiments.

Although not necessary, a hydroxide compound such as KOH or NaOH may be used to trigger or initiate hydrogen production. This addition may accelerate the process, as the reaction between water and the oxidizable metallic nanoparticles will start more quickly. As KOH or NaOH may only be used to initiate the reaction, and not to keep the reaction ongoing, a small or catalytic amount of KOH or NaOH may be sufficient.

In embodiments, pressure waves generated within the working liquid due to the water hammer effect may rapidly change the speed of the working liquid and create turbulent flows. When the oxidizable material, such as silicon, is subjected to the pressure waves, the oxidizable material may break apart and mix effectively with the working liquid, enhancing contact between the oxidizable material and the water. The reaction between the oxidizable material and the water to produce hydrogen gas may be increased, as the oxidizable material would be dispersed and exposed to the water molecules.

In embodiments, the collapse of the bubbles formed in the working liquid generates localized regions of high pressure and temperature. This high temperature may help to trigger and accelerate the reaction between water and the oxidizable material. The bubble collapse also releases a high amount of energy in the form of shockwaves. This energy may also help to trigger the reaction between the oxidizable material and the water molecules. In embodiments, the following reaction may occur due to the high temperature and high pressure conditions: $Si+2H_2O \rightarrow SiO_2+2H_2$. Additionally, in embodiments, bubble collapse may help to break down the oxidizable material and to expose more surface area of the material which is then available for reacting with water. In addition, bubble collapse may generate strong hydrodynamic shear forces which may remove outer layers of the oxidizable material. The exposed inner layers may react more easily with the water molecules, enhancing the production of hydrogen gas. In embodiments, pressure waves and bubble collapse may increase the collisions between the oxidizable material, accelerating its reduction to a smaller size.

The water hammer and cavitation effects can work synergistically to create favorable conditions for hydrogen production. The water hammer effect may induce turbulent flows and help to mix the oxidizable material with water, which may prepare the water and the oxidizable material for receiving the shock waves produced by the bubble collapse. These shock waves may further enhance mixing and reactivity, creating a beneficial environment for efficiently generating hydrogen gas.

It should also be noted that nanoparticles suitable for producing hydrogen with the apparatus described herein may also be used to produce hydrogen outside the apparatus. For example, the nanoparticles may be mixed with water, such as seawater, for producing hydrogen in a suitable container outside the apparatus. For example, a reactor may be used for producing the hydrogen. The reactor may be operatively connected to the apparatus in embodiments.

In embodiments, the apparatus described herein may also be used for other purposes, such as generating other gases besides hydrogen. For example, a gas generated during the process may be or may include syngas, methane ($CH_4$), carbon monoxide (CO), carbon dioxide ($CO_2$), oxygen ($O_2$), hydrocarbon gas, and others.

For example, the core and apparatus may be configured to produce syngas from coal and water, emulating a water-gas shift reaction. In embodiments, a gas such as CO may be added to the water for producing a water-gas shift reaction, in which CO reacts with $H_2O$ for producing $CO_2$ and $H_2$. Methane ($CH_4$) and other carbon-based fuels may also be introduced in the apparatus. For example, $CH_4$ may be added to the water for producing $CO_2$ and $H_2$. In other examples, $CO_2$ may be used, together with water, to produce CO. Syngas may efficiently be generated. Catalysts such as calcium and copper-silicon may help to enhance the efficiency of producing CO from $CO_2$.

In embodiments, the apparatus may therefore be used to generate gases such as syngas or hydrogen in which the nanoparticles obtained may be used subsequently for other applications.

It should be noted that in examples where a gas is added to, or mixed with, the working liquid, the working liquid may include the gas before it is introduced in the apparatus, or the gas and the working liquid may be introduced in the apparatus separately and mixed within the apparatus, for example in the core. In embodiments, the apparatus may include one or more inlets through which one or more gases may be introduced in the apparatus, optionally in the core.

In embodiments, the method and apparatus described herein may also be used for liquefying coal by hydrothermal liquefaction (HTL). Coal and water may therefore be added to the core of the apparatus. Therein, the coal and the water may be subjected to high pressure and high temperature. This temperature may break up the coal into simpler organic compounds, and the solid coal and water may form a coal slurry. In embodiments, the coal may therefore be liquefied. Depending on which additional elements are added with the coal, other products such as biodiesel, including methanol or ethanol, may be obtained.

As oils and bio-oils, such as those which have already been used in other processes, include a significant amount of carbon and hydrogen, adding them with the coal may help to increase the yield of the corresponding product. Catalysts, for example biodiesel or methanol, may help to expedite the liquefaction process and promote the conversion of coal and other additional elements into working liquid products.

In embodiments, alcohol sources such as methanol or ethanol may be included in the core with the coal. The high temperature and high pressure inside the core may promote the formation of working liquid fuels in embodiments which include methanol or ethanol.

In embodiments, after HTL, the obtained product, which may be a slurry, may be refined. Separation techniques, for example distillation, may be used to purify the obtained product.

Particular aspects, embodiments and elements of aspects or embodiments disclosed herein can be combined together in any number and order to form new aspects and embodiments that form part of this disclosure.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is not limited to the particular systems, devices and methods described, as these may vary. The terminology used in the description is for the purpose of describing the particular versions or embodiments only and is not intended to limit the scope. In fact, it will be apparent to those skilled in the art that various modifications and variations can be made in the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "including" various components or steps (interpreted as meaning "including, but not limited to"), the compositions, methods, and devices can also "consist essentially of" or "consist of" the various components and steps, and such terminology should be interpreted as defining essentially closed-member groups. It will be further understood by those within the art that if a specific number of an introduced claim recitation is intended, such an intent will be explicitly recited in the claim, and in the absence of such recitation no such intent is present.

For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "including" means "including, but not limited to."

As used herein, the term "about" means plus or minus 10% of the numerical value of the number with which it is being used. For example, "about 50%" means in the range of 45-55%, and also includes exactly 50%. That is, any value herein modified by "about" also discloses the value itself.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art all language such as "up to," "at least," and the like include the number recited and refer to ranges that can be subsequently broken down into subranges as discussed above. Finally, as will be understood by one skilled in the art, a range includes each individual member. Thus, for example, a group having 1-3 compounds refers to groups having 1, 2, or 3 compounds. Similarly, a group having 1-5 compounds refers to groups having 1, 2, 3, 4, or 5 compounds, and so forth.

Various of the above-disclosed and other features and functions, or alternatives thereof, may be combined into many other different systems or applications. Various presently unforeseen or unanticipated alternatives, modifications, variations, or improvements therein may be subsequently made by those skilled in the art, each of which is also intended to be encompassed by the disclosed embodiments.

What is claimed is:

1. An apparatus for producing nanoparticles of a material in a working liquid, comprising:

one or more inlets for introducing the working liquid, the material, or a combination thereof into the apparatus;

a core for accelerating the working liquid and the material, wherein the core comprises:

a first cylinder comprising:

a radially outer surface and a radially inner surface; and a plurality of first through holes extending from the radially inner surface to the radially outer surface of the first cylinder;

a second cylinder comprising:

a radially outer surface and a radially inner surface; and a plurality of second through holes extending from the radially inner surface to the radially outer surface of the second cylinder;

wherein the second cylinder radially surrounds the first cylinder;

wherein each of the first through holes and the second through holes have a smaller cross-section at the radially inner surface than at the radially outer surface; and one or more drives for rotating the first cylinder, the second cylinder, or a combination thereof.

2. The apparatus of claim 1, wherein the plurality of first through holes, the plurality of second through holes, or a combination thereof each have a substantially elliptical cross-section.

3. The apparatus of claim 1, wherein the plurality of first through holes, the plurality of second through holes, or a combination thereof comprise a first side edge and a second side edge in a cross-section perpendicular to an axial direction of the first cylinder and the second cylinder, and wherein the first side edge is curved and the second side edge is straight.

4. The apparatus of claim 1, wherein at least some of the plurality of first through holes are arranged in first circumferential rows and at least some of the plurality of second through holes are arranged in second circumferential rows, wherein one or more of the first circumferential rows have a same axial position as one or more of the second circumferential rows.

5. The apparatus of claim 4, wherein the first and second circumferential rows have a constant pitch within a row.

6. The apparatus of claim 1, wherein the first cylinder and the second cylinder have a radial separation of 10 microns to 1 cm.

7. The apparatus of claim 1, wherein a distance between each of the plurality of second through holes is larger than a distance between each of the plurality of first through holes.

8. The apparatus of claim 1, further comprising a third cylinder, comprising:

a radially outer surface and a radially inner surface; and a plurality of third through holes extending from the radially inner surface to the radially outer surface;

wherein the third cylinder surrounds the second cylinder; and wherein the plurality of third through holes have a smaller cross-section of at the radially inner surface than at the radially outer surface.

9. The apparatus of claim 1, wherein the first cylinder further comprises a plurality of grinding balls.

10. The apparatus of claim 1, further comprising a separator system for separating the material from the working liquid.

11. The apparatus of claim 1, further comprising a collection system for collecting the nanoparticles of the material.

* * * * *